US006004034A

United States Patent [19]

Salam

[11] Patent Number: 6,004,034

[45] Date of Patent: Dec. 21, 1999

[54] BODY BAG AND METHOD OF MAKING

[76] Inventor: Abdul Salam, P.O. Box 6847, Laguna Niguel, Calif. 92607-6847

[21] Appl. No.: 09/146,393

[22] Filed: Sep. 1, 1998

[51] Int. Cl.[6] ..... B65D 30/10; B65D 33/16

[52] U.S. Cl. ..... 383/66; 27/28; 383/97; 493/213; 493/243

[58] Field of Search ..... 383/66, 97; 27/28; 493/213, 214, 243, 244

[56] References Cited

U.S. PATENT DOCUMENTS

| | | | |
|---|---|---|---|
| 710,745 | 10/1902 | Boucher | 383/66 |
| 2,418,589 | 4/1947 | Lifton | 383/66 |
| 2,734,584 | 2/1956 | Spooner | 383/97 |
| 3,115,959 | 12/1963 | Jaffe | 383/66 |
| 4,790,051 | 12/1988 | Knight | 27/28 |
| 4,890,935 | 1/1990 | Ausnit et al. | 383/64 |

*Primary Examiner*—Stephen P. Garbe
*Attorney, Agent, or Firm*—James G. O'Neill

[57] ABSTRACT

A single piece of material is cut from a roll of material, folded along fold lines and secured together along abutting short ends and mating portions to form a body bag which is stronger. The body bag includes a zipper closure that is formed when specifically sized and shaped ends of the single piece of material have one half of a zipper secured thereto and are then folded so as to be together. The abutting short ends and the mating portions of the sheet of material are secured together, as by sewing, or the like, to form a body bag having a minimum number of secured together edges or mating portions susceptible to being pulled or torn apart, and requiring less labor to complete.

11 Claims, 2 Drawing Sheets

BODY BAG AND METHOD OF MAKING

BACKGROUND OF THE INVENTION

1. Field of the Invention

This invention relates generally to body bags, and, more particularly, to an improved body bag and the method of making the same.

2. Description of Related Art

The exterior edges and ends of a zipper closure in a body bag are subjected to accidental abuse, damage, or mistreatment, particularly during moving or transporting the body bag with a body therein. Due to the high risk of infection, etc., if body fluids escape from a body bag while being transported or moved, a need it exists to protect the vulnerable portions of body bags from accidental damage or harm because of rough handling, or contact with sharp objects.

Different types of body bags and methods for making them are known. Generally, one piece of rectangular material is cut to size is and folded over, or two or more rectangular portions of material are cut, and then sealed or sewn together along one long side edge and two ends, or two side edges and two ends to form the bag. A zipper closure is then added to the top surface of the body bag to enable a body to be inserted in and removed from the bag. However, after many attempts to solve the problems of manufacturing a relatively low-cost body bag, which will be strong enough to hold up under rough handling, without rupturing or tearing, there still exists a need in the body bag art for a relatively simple, easy-to-use, low cost and strong body bag, that has fewer sealed or sewn side edges, and which is less vulnerable to damage, such as tearing during handling.

SUMMARY OF THE INVENTION

Accordingly, it is a general object of the present invention to provide an improved body bag. It is a particular object of the present invention to provide an improved body bag constructed in a more efficient manner. It is a still more particular object of the present invention to provide an improved body bag having strengthening means at the ends of a zipper closure. It is yet a more particular object of the present invention to provide an improved body bag made from a single piece of material, secured together along a minimum number of side edges. It is a further object of the present invention to form a body bag that wastes a minimum amount of material. And, it is a still further object of the present invention to provide a method of forming an improved body bag having increased strength and utilizing less labor.

In accordance with one aspect of the present invention, there is provided a single piece body bag assembly for use in holding and securing bodies. This assembly is provided with a minimum of sealed or welded edges, as well as strengthening means for end portions of a zipper closure. Furthermore, the single piece body bag of the present invention is easily constructed from material cut from a roll of material with substantially no waste. Additionally, the method of the present invention allows body bags to be easily assembled with a minimum amount of sealing, welding or sewing to form a body bag which is less susceptible to rupturing or tearing.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved body bag and method of making the same.

Figure 1:
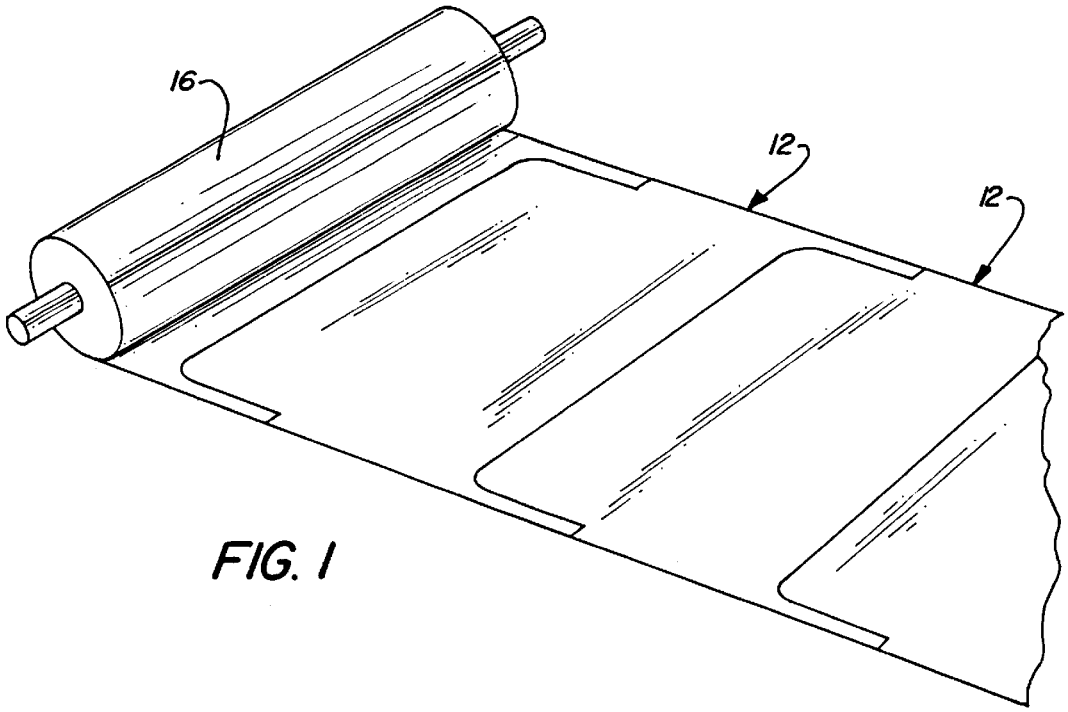
FIG. 1 is a perspective view of a roll of material having a number of blanks or pieces of materials cut thereon for making improved body bags in accordance with the present invention.
Figure 2:
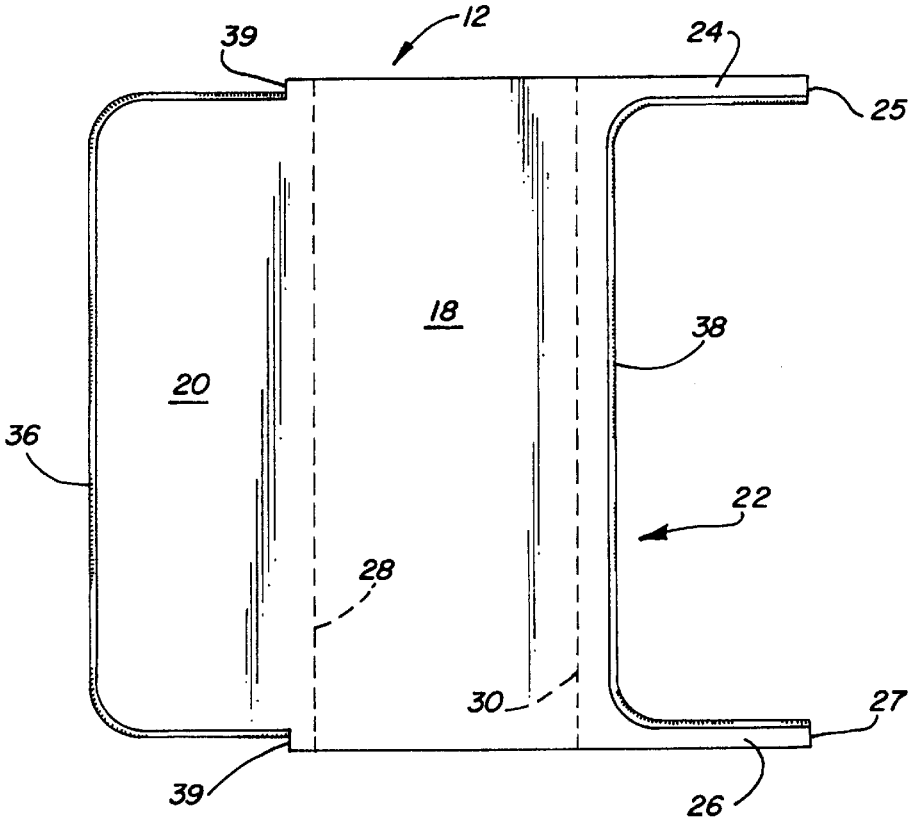
FIG. 2 is a top plan view of a single piece of material taken from the roll of FIG. 1 and used to make a body bag.
Figure 3:
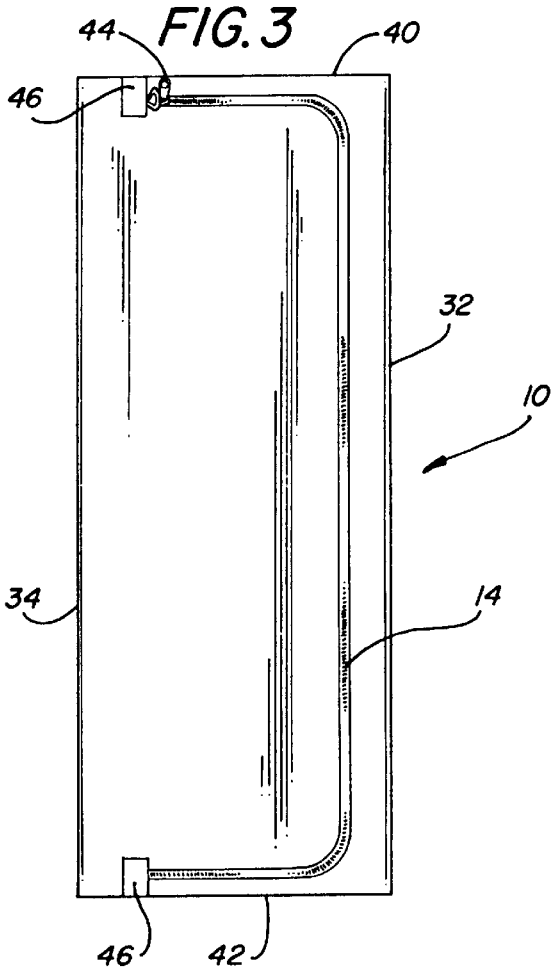
FIG. 3 is a top plan view of an assembled body bag, made from the single piece of material of FIG. 2.
Figure 4:
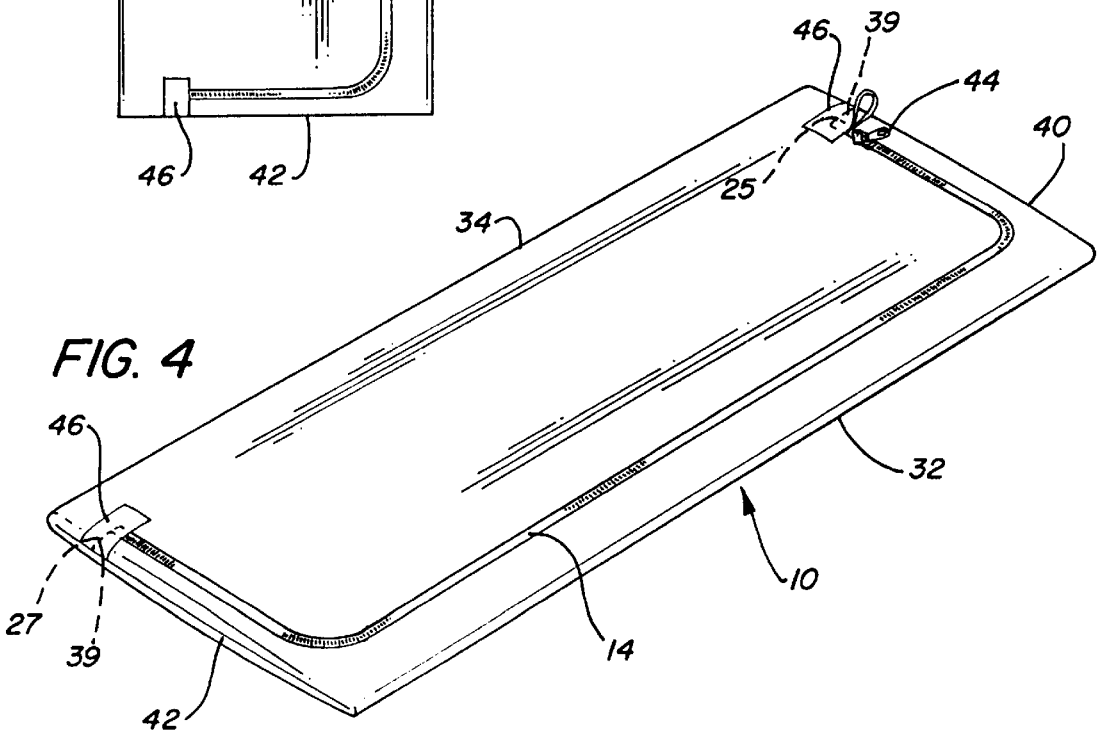
FIG. 4 is a perspective view looking toward the top of the assembled body bag of FIG. 3.

Referring to FIGS. 1–4 of the drawings, a body bag 10 is shown as being made from a single piece or section of material 12. The single piece of material 12 is folded and secured together, as by sealing, sewing, sonic welding, or the like, to form a completed bag 10 having a zipper closure 14 on an upper surface thereof (FIGS. 3 and 4).

As shown in FIG. 1, a plurality of sections of material 12 are cut from a roll of material 16 in a predetermined pattern, to eliminate wastage. As shown in FIG. 2, each one piece section 12 is preferably comprised of a substantially rectangular central area or portion 18, a first or left end flap 20 and a second or right end open U-shaped area or portion 22, having a pair of extending arms 24, 26, ending in substantially flat ends 25, 27. These areas or portions, as best shown in FIG.2 in the open or prefolded position, are folded along fold lines 28, 30 to form closed elongated side edges 32, 34 and shorter ends 40, 42, as shown in FIGS. 3 and 4. Before being folded along fold lines 28, 30, the outer edges of flap portion 20 and the inner edge of the U-shaped portion 22, including the inner edges of arms 22, 24, have two (2) separate elongated cloth elements with teeth 36, 38, which when mated form the zipper closure 14, attached thereto, as by sealing, sewing, or the like.

Also, as shown in FIG. 2, when cut, each section of material 12 includes a pair of indented portions or notches 39, at the outer edges of the flap 20 adjacent the rectangular central portion 18. These notches 39 will mate with the flat ends 25, 27 of arms 24, 26, as explained more fully below.

After being folded along fold lines 28, 38, the open smaller ends 40, 42 formed thereby have abutting edges thereof secured together, as by sewing, or the like, and the opposite elongated cloth elements 36, 38 are brought together to form zipper closure 14, so that teeth thereon may be secured or unsecured together by a pull tab or tongue 44, in a known manner. Furthermore, the flat outer ends 25, 27 of arms 24 and 26 are brought into contact with the notches 39 and the resulting seams formed thereby are secured together as by sewing, or the like, (see FIG. 4). To further seal the seams formed by the mating of ends 25, 27 to the notches 39, patches of material 46 are sealed or otherwise secured over the seams, thus forming a stronger bag utilizing a minimum amount of labor.

It, therefore, can be seen that each single piece of material or section 12 is cut from the roll of material 16, as by use of a pattern or other guide means, without producing waste. Each single piece of material is cut to a predetermined size, depending on the size of the finished body bag 10, it is desired to make. For example, if the roll of material 16 is 96" wide, an adult size body bag would be made from each section 12 cut from this roll. Other size bags would, of course, be made using different width rolls of material, and cutting sections therefrom, in a similar manner.

The present invention provides an improved and novel body bag that allows bodies of various sizes to be easily and quickly bagged in a secure, leak-resistant manner. The formed body bag has a minimum of sewn or secured ends which would be subject to tearing. That is, since both longer side edges 32, 34 are formed by folded over material, instead of at least one being secured together edges of cut material, these longer side edges add strength and durability to the bag and require less labor to manufacture. Also, the patches 46 provided over the small seams holding the notches 39 and flat ends 25, 27 together, add security and strength to both the seams and the ends of the zipper closure, to prevent tearing.

Those skilled in the art will appreciate that the above-described preferred embodiments are subject to numerous modifications and adaptations without departing from the scope and spirit of the invention. Therefore, it is to be understood that, within the scope of the appended claims, the invention may be practiced other than as specifically described herein.

What is claimed is:

1. A body bag for holding a human body in a secure, fluid-tight manner, comprising:

a single piece of material which is folded and has mating elements secured together to form the body bag;

the single piece of material having a substantially rectangular shaped central portion; a flap-like portion fixed to one side of the rectangular shaped central portion; and a U-shaped open portion having a pair of arms fixed to a second side of the rectangular shaped central portion; and complementary securing elements fixed to an outer edge of the flap-like portion and an inner edge of the U-shaped open portion, whereby when the single piece of material is folded, the outer edge and the inner edge are brought together, and the complementary securing means fixed thereto may be operated to seal the body bag.

2. The body bag of claim 1, further including patches permanently securing flat ends of the pair of arms to the flap-like portion.

3. The body bag of claim 2 wherein the complementary securing elements are two elongated cloth elements having teeth of a zipper closure.

4. The body bag of claim 3 wherein the single piece of material is folded along folded lines into a body bag having an upper surface, a lower surface, two long side edges and two shorter ends, with the zipper closure held in the upper surface.

5. The body bag of claim 1, further including fold lines in the rectangular shaped portion whereby the flap-like portion is folded to fit into and mate with the open U-shaped portion.

6. The body bag of claim 5 wherein the complementary securing elements are two elongated cloth elements having teeth which form a zipper closure in a top surface of the formed body bag.

7. The body bag of claim 6 wherein when the single piece of material is folded along the fold lines, two long side edges and two shorter ends are formed, whereby only the two shorter ends are sealed together after folding to form the body bag.

8. A method of forming a fluid-tight body bag having a zipper closure on a top surface, comprising the following steps:

forming a sheet of material to a desired size and shape having a rectangular central portion; a flap-like first end portion and a U-shaped second end portion;

fixing complementary halves of the zipper closure to the flap-like first end portion and the U-shaped second end portion;

folding the sheet of material along fold lines in the rectangular central portion to form a body bag with two open short ends and two closed longer side edges, which two closed longer side edges extend along the fold lines;

securing abutting edges of the two open short ends together to thereby form the body bag with the zipper closure on the top surface; and securing patches of material to the top surface along seams made by the mating of notches formed in the flap-like first end portion adjacent the rectangular central portion, and flat outer arm ends of the U-shaped second end portion.

9. A body bag for holding a human body in a secure, fluid-tight manner, comprising:

a single piece of material adapted to be folded to form a body bag; the single piece of material having a substantially rectangular shaped central portion; a flap-like portion fixed to one side of the rectangular shaped central portion; a pair of notches formed on side edges of the flap-like portion, adjacent the rectangular shaped central portion; and a U-shaped open portion having a pair of arms with flat ends fixed to a second side of the rectangular shaped central portion; and complementary halves of a zipper closure fixed to an outer edge of the flap-like portion and an inner edge of the U-shaped open portion, whereby when the inner edge and the outer edge are folded toward the rectangular shaped central portion, and mated together, the complementary halves of the zipper closure will be in position where they may be operated to open and close the body bag.

10. The body bag of claim 9, further including patches permanently securing the flat ends to the side edges of the flap-like portion.

11. The body bag of claim 10 wherein the single piece of material is folded into the body bag having an upper surface, a lower surface, two long closed side edges and two shorter open ends, with the zipper closure held in the upper surface; and wherein only the two shorter open ends are sealed shut along mating edges.

* * * * *